United States Patent [19]

Nicholls

[11] 4,446,083

[45] May 1, 1984

[54] AIR-INFLATED FABRIC-REINFORCED CONCRETE SHELLS

[76] Inventor: Robert L. Nicholls, 302 Beverly Rd., Newark, Del. 19711

[21] Appl. No.: 289,469

[22] Filed: Aug. 3, 1981

[51] Int. Cl.[3] ..... E04B 1/16

[52] U.S. Cl. ..... 264/32; 52/2; 52/741; 264/240; 264/255; 264/256; 264/250; 264/314; 264/333

[58] Field of Search ..... 52/2, 745, 741, 125.1; 264/45.7, 32, 258, 256, 255, 333, 314

[56] References Cited

U.S. PATENT DOCUMENTS

| | | | |
|---|---|---|---|
| 3,057,054 | 10/1962 | Barnes | 52/2 |
| 3,557,515 | 1/1971 | MacCracken | 264/32 |
| 3,643,910 | 2/1972 | Heifetz | 264/32 |
| 3,842,550 | 10/1974 | Duquette | 52/2 |
| 3,922,832 | 12/1975 | Dicker | 52/747 |
| 4,094,109 | 6/1978 | Prouvost | 52/2 |
| 4,170,093 | 10/1979 | Cappellini et al. | 52/2 |

*Primary Examiner*—John E. Murtagh
*Assistant Examiner*—Kathryn Ford

[57] ABSTRACT

A technique for constructing inflated shell enclosures in which (1) cementing matrix and reinforcing material components are placed on an inflatable membrane before inflation except that one component, which is required for hardening the cementing matrix, is sprayed on after inflation, (2) the reinforcing material is a textile fabric, interbedded with the cementing matrix to form a laminate, and (3) the hardened shell can be lifted to a raised position for permanent support by removing anchorages at its perimeter used during inflation for hardening, and inflating the space between the hardened shell and the membrane, which reacts against a supporting base surface to lift the shell.

The fabric stretches slightly under inflation pressure so that shells having circular and polygonal perimeters, with center rises from one tenth to one fifth of the span, can be constructed with flat (untailored) fabrics. By tailoring the outer fabric and overlapping inner fabric layers anchored at one side only, rise/span ratios of about $\frac{1}{3}$ are obtained without appreciable loss of uniformity in shell thickness.

Potential applications include roofs for grain and bulk storage containers, farm and industrial sheds and enclosures, and earth-bermed or earth-covered homes.

1 Claim, 4 Drawing Figures

AIR-INFLATED FABRIC-REINFORCED CONCRETE SHELLS

BACKGROUND OF THE INVENTION

Inflated concrete shell enclosures have been built by various methods, including:

1. Inflating a bag, covering it with reinforcing mesh, spraying it with concrete, then removing the bag through an opening in the hardened shell for reuse.

2. Inflating a bag containing an air lock door, spraying the inside of the bag with insulating foam, spraying the inside of the insulating foam with concrete, then removing the bag from the outside for reuse, or leaving the bag as a permanent water proof covering (U.S. Pat. No. 3,277,219).

3. Placing concrete and an expandable reinforcing members on an elastic membrane at ground level, then inflating the membrane and vibrating the surface to insure continuity of concrete over the expanded surface area of the resulting shell (U.S. Pat. No. 3,462,521).

4. A method combining elements of methods 1 and 3, in which reinforcing and a thin layer of concrete are placed on the elastic membrane at ground level and the membrane is inflated. When the thin layer has hardened, and while the membrane is still inflated, a second layer of reinforcing and a thicker layer of concrete are applied over the thin layer (U.S. Pat. No. 4,170,093). The advantages claimed for this method are that it allows larger shells to be formed than does method 3, since the thin layer of concrete can be placed on a larger surface area and inflated before it begins to harden whereas a thicker layer could not, and that it avoids the scaffolding required for the guniting or shotcreting used in method 1, since the combination of inflationpressure and hardened thin layer provide a surface rigid enough for workmen to walk upon.

5. U.S. Pat. No. 3,643,910 describes perimeter framing techniques for inflated shell construction, including one scheme consisting of an inflatable double membrane between upper and lower tensioning cables extending across and anchored to opposite sides of a circular perimeter frame. The cables contain and determine the shape of the inflated double membrane. Concrete is poured on the upper membrane, either before or after inflation, and the upper cables become embedded in the concrete to serve as shell reinforcement.

The perimeter ring may be supported on a pre-constructed ring wall, before inflating the membrane and placing concrete. However, since the upper and lower membrane are constrained between the upper and lower tensioning cables, and since the tensioning cables cannot be removed because they are integral and necessary structural elements of this system, neither upper nor lower membrane can be made to react against a supporting base in order to raise the hardened shell in a manner to be described in the present invention.

Some disadvantages of all of the cited methods include:

1. The required use of a wet concrete mix and the attendant time limitations imposed by hardening of the concrete. In methods 1 and 2 either all concrete must be placed before any of it begins to harden, since the bag deforms under the weight of concrete, or else a very rigidly inflated bag, requiring expensive membrane and anchorages must be used. In methods 3 and 4, the concrete must be placed, the bag safely inflated, and in method 3 the concrete adequately vibrated, before the concrete begins to harden. A construction delay for any reason (delayed concrete delivery, faulty air seal, power outage, unfavorable weather) between placing the first concrete and having all concrete in its final position for hardening may void or reduce the structural integrity of the shell.

2. The large investment of labor required to place and properly anchor numerous individual reinforcing members and the cost in materials and time to properly position the reinforcing members within the thickness of the shell cross section. The reference for method 4 additionally describes the need to bond the two concrete layers together with an adhesive and to tie the two reinforcing layers together.

3. The required cost of specialized equipment and skilled labor for guniting or shotcreting for all of the cited methods except method 3, in which method the shell size is limited by the concrete hardening duration constraint previously described.

4. For some applications, the restricted usefulness of the shell enclosure due to limited headroom near the perimeter and the increased cost of acceptable window and entry installation due to the lack of vertical walls. Method 5 overcomes this limitation, but at the cost of having to place concrete above ground level, requiring pumped concrete or alternative means of lifting wet concrete.

SUMMARY OF THE INVENTION

The object of this invention is to provide an air-inflated shell enclosure construction technique which overcomes the previous limitations and has the following advantages:

1. The speed and ease of spreading dry cement or mortar at ground level, rather than either screeding wet mortar or concrete on a flat surface or applying it to a curved surface by pumping, guniting, or shotcreting.

2. The elimination of working duration restrictions imposed by the setting time of inorganic or organic cements, since the shell shape is formed before one of the components required for hardening is added (as water in the case of portland cement or a catalyst-activator in the case of a polyester sheet molding compound).

3. The low cost, light weight, and ease of handling and cutting wide rolls of textile reinforcing fabric, compared with cutting and anchoring wire mesh or individual steel reinforcing members.

4. The fabric is sufficiently deformable that shallow shells can be produced from flat sheets without developing wrinkles at the shell perimeter, which is not possible with wire meshes.

5. The several layers and finer texture of the fabric permit it to contain the dry cement and keep it in position as the laminate is being inflated, tending to eliminate the opening of cracks in the cement as the surface area increases due to inflation.

6. The finer texture of the fabric also provides a structurally more efficient and economical in-plane spacing of reinforcing strands for thin shells than do wire meshes.

7. The finer texture of the fabric and the use of polymer rather than metallic reinforcing allows most of the reinforcing fabric to be placed near the inner and outer surfaces of the laminate where it can fulfill its function as tensile reinforcement to resist laminate flexural buckling more efficiently than metal reinforcements, which require either costly metals or greater embedment in concrete to retard metallic corrosion. In other words, for equal buckling resistance, properly selected textile fabrics can permit the use of thinner shells, requiring lower material and labor costs for both cement and for reinforcing.

8. The simplicity and low cost of raising the hardened shell by air pressure to its final elevation.

In summary, the novel, nonobvious, and economically significant features of this invention over all of the cited references include three:

1. The placement of shell laminate material components onto the membrane before inflation except for one, required for hardening, which is sprayed on after inflation, thus permitting, without risk to the structural integrity of the shell, an indefinite period of delay between laying of the materials at ground level and final hardening of the shell.

2. The use of textile fabric instead of metallic reinforcements, permitting reduced material and handling costs and more structurally efficient placement of the reinforcement throughout the thickness of the shell cross section.

3. A very inexpensive and simple means (since all necessary equipment and nearly all necessary material components were previously used to inflate the laminate for hardening) of raising the shell to make it more useful for some intended purposes, as for example by allowing more adequate head room near the perimeter of shell and/or by supporting it on vertical walls into which conventional windows and doors can be installed.

DESCRIPTION OF THE DRAWINGS

This object can be accomplished by the accompanying construction sequence, described in conjunction with the following drawings.

DESCRIPTION OF THE EMBODIMENTS

Figure 1:
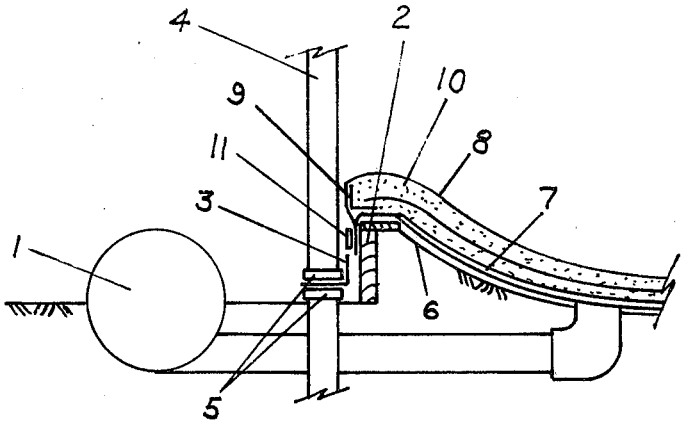
FIG. 1 is an elevation view of the shell edge after the reinforcing fabric has been anchored to the edge frame.
Figure 2:
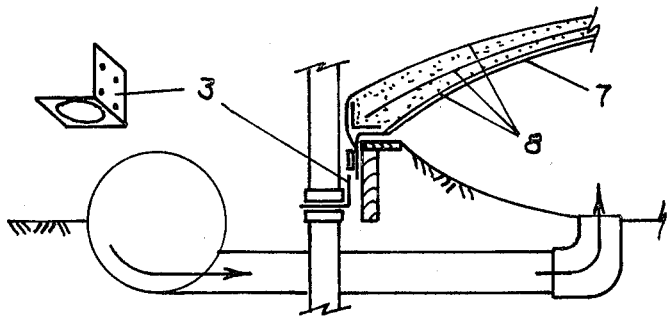
FIG. 2 is an elevation view of the shell edge after the shell has been inflated for mortar hardening.
Figure 3:
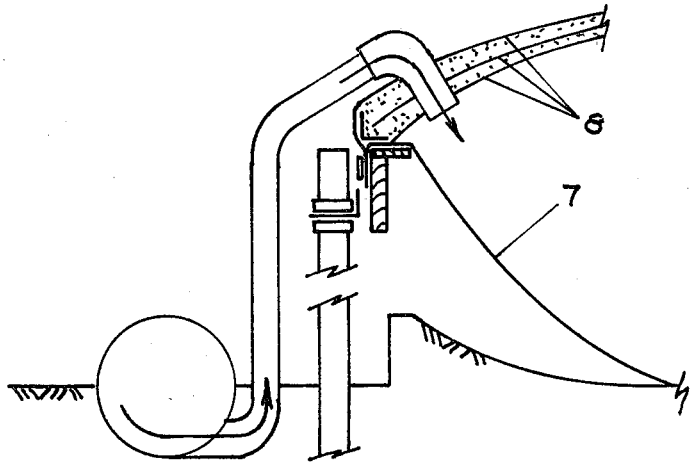
FIG. 3 is an elevation view of the shell edge after the hardened shell has been raised to its final elevation by inflation.
Figure 4:
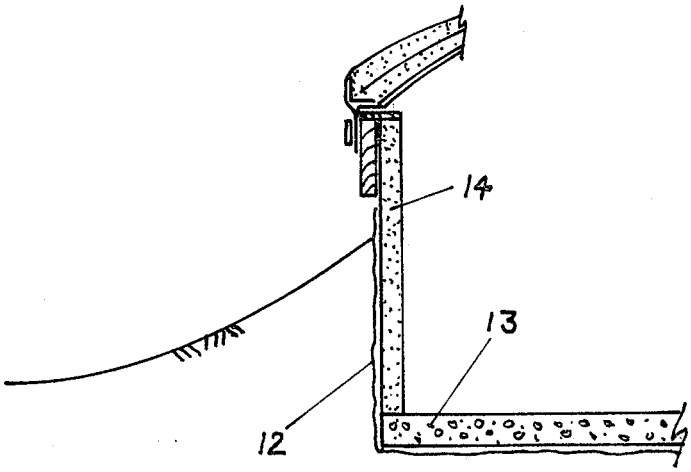
FIG. 4 is an elevation view of the shell edge after a floor slab and load-bearing wall have been built under the shell, and temporary support posts have been removed.

Referring to FIGS. 1 through 4, a suitable construction sequence for shell roofs consists of the following steps:

1. Grade the building site, and drive stakes at the building corners.

2. Place a ventilating blower (1) near the building with a discharge pipe in a shallow trench extending into the building area.

3. Set a wood edge frame (2) around the building perimeter with post collar angles (3) attached to the frame at about 10 ft. spacings.

4. Auger post holes through the collars (3). Insert and tamp pipe posts (4). Place pipe clamps (5) on each post above and below the collar (3). This fixes the edge frame at uniform elevation and keeps it from being drawn inward due to reinforcing fabric tension while the mortar is hardening.

5. Grade a shallow earth berm (6) against the inside of the edge frame.

6. Lay the air seal (7) and bottom reinforcing (8) so that they overlap the edge frame.

7. Lay the perimeter angle (9) over the air seal and bottom reinforcing fabric, and nail it to the edge frame.

8. Spread dry mortar (10) with screeds. Lay reinforcing fabric layers (8) between layers of mortar.

9. Nail wood molding strip (11) to anchor all fabric layers and air seal to the edge frame.

10. Inflate the dry mortar-fabric laminate with the blower.

11. Densify the dry mortar and work it thoroughly into the reinforcing fabric layers by vibrating near the shell perimeter with a vibratory screed. Spray the shell with a hose until it appears saturated, and continue to vibrate near the shell perimeter.

12. Discontinue inflation when the shell hardens sufficiently to support itself (typically 8–12 hr).

13. When the shell is sufficiently strong for lifting (typically 7 days):

(a) Reset the upper clamps (5) at a height on the posts desired for final edge frame elevation.

(b) Drill a hole in the shell and insert a plastic pipe, connected to the blower, so that the space between the air seal and shell will be inflated.

(c) Start the blower. When collars (3) rise to press against upper clamps (5), raise the lower clamps to support the collars, then discontinue inflation.

14. Cut openings in the shell for skylights with a power hand saw. Leave the shell supported on the posts, or excavate and add a moisture seal film (12), floor slab (13), and walls (14), if needed. Release the lower clamps (5) to let the edge frame rest on load bearing walls. Remove collars (3) and posts (4) for reuse. The air seal (7) may be cut away at the edge frame and used as a water-proof cover for the shell.

The major material requirements include:

1. Pipe posts (4)
2. Lumber for edge frames (2) and molding strips (11)
3. Vinyl-backed spunbonded polypropylene (or other) air seal (7)
4. $1\frac{1}{2}$ oz/yd$^2$ spunbonded polypropylene or alternative fabric or fibrillated film reinforcing (8)
5. Perimeter angle (9) and mortar (10)

The major equipment requirements include:

1. Ventilating blower (1)
2. Hand garden tools (or a small garden tiller) to make the shallow earth berm.
3. An earth auger for drilling post holes
4. A screed for leveling the mortar
5. A hand-held vibratory screed for densifying the mortar
6. A garden hose and water source Several aspects of the construction and materials selection require explanation:

Grading.

The earth bermed against the inside of the edge frame serves (a) to reduce air leakage under the frame, and (b) to provide a supporting surface upon which to spread mortar up to the perimeter angle.

Alternatively, the edge frame can be set in a narrow trench and backfilled, or nailed to the edge of a preexisting floor slab. The masonry nails should be driven only part way, to permit easy removal for raising the shell.

Setting support posts.

The support posts must be tamped while backfilling in order to provide adequate anchorage against uplift and lateral displacement during inflation, and must be approximately vertical so that binding between the collars and posts does not occur when the hardened shell is raised. Posts have been backfilled with sand and tamped with a thin metal bar which slips between the post and collar. Smaller diameter posts can be used if diagonal cross ties (from ground level to top of adjacent post) are added between several posts on each side of the shell to improve sway stability.

Reinforcing fabric.

Compared with steel mesh reinforcings used in thin shells, open-textures spunbonded polypropylene fabric is light weight, flexible, easy to cut, sew, and handle, and does not rust.

Compared with other polymer fabrics, polypropylene has the relative advantages of high tensile strength and high modulus per unit cost, and resistance to degradation at the 13+ pH values of hydrating cement. Since polypropylene is nonpolar, the fabric apparently bonds with cement paste primarily by mechanical interlocking. Cement paste does not readily penetrate heavier fabrics, even under high inflation pressures, making their reinforcing values questionable.

Mortar mix.

Dry sand-cement mixes and dry bagged cement or bulk cement delivered by blower truck have all been used. Pozzolith 122 High Early, a concrete additive containing an accelerator and a water-reducing agent, can be introduced from an aspirator bottle and nozzle attached to the hose. The water-reducing agent accelerates penetration of water through the thickness of the dry mortar laminate, and the accelerator reduces the required inflation period by shortening the time to which the shell can be self-supporting.

Inflation for mortar hardening.

During mortar curing, the inflation pressure needs to be somewhat greater than enough to lift the mortar, i.e. the blower must provide, at zero discharge rate, more than 150 lb per $ft^3$/62.4 lb per $ft^3$=2.4 in. of static water pressure (SP) for each inch of concrete shell thickness. In practice, pressures approximately one and one half this amount have been used, to insure a stable shell configuration in moderate winds while the mortar hardens. Shell rise-to-span ratios of 1:5 to 1:10 are normal, without tailoring. Ratios greater than 1:5 begin to produce some fabric wrinkling at the shell perimeter, which is unsightly even though the fabric-mortar bond is still tight. Ratios less than 1:10 become more costly because of the excessive shell thicknesses required to resist increased membrane stresses in flatter shells. The rise-to-span ratios can be increased by (a) using greater inflation pressure, which stretches the fabric more, and (b) leaving a small amount of slack in the fabric layers when anchoring them to the edge frame.

Inflation to raise the shell.

To lift the hardened shell, the air pressure times the contact area between the air seal and the ground must equal the weight of the shell. As the air seal inflates under increasing pressure, the contact area between the air seal and ground reduces until these two forces balance (as in vehicle tires), or until collars on the posts restrict continued upward movement of the shell.

In model studies, an air seal-ground contact area of about one half of the shell area has been typical, requiring an inflation of 2×2.4=4.8 in. SP for each inch of concrete shell thickness. ⅓RD HP and larger radial blade ventilating fans attain zero discharge pressures of 6 in. SP and more, adequate for shells about 1½ in. thick and greater.

The vertical lift attainable when the shell is raised is typically about two thirds of the shell rise, when the same inflation pressure is used for raising the shell as was used during mortar curing. Thus, a shell of 54 ft. span and 9 ft. rise might be expected to be lifted only 6 ft. If an 8 ft. wall height were required, several options are available:

(a) The floor can be placed 2 ft. below grade by excavating to that level after the shell is raised.

(b) A 2 ft. mound of earth can be graded within the edge frame before laying the air seal. The mound can be removed after the shell is raised.

(c) Tailoring the air seal to permit a higher shell rise upon inflation.

(d) Reusable inflation pillows can be laid on the ground before laying the air seal, and inflated simultaneously with the air seal to increase the height of shell rise. The pillows, made of the same material as the air seal, are light weight, rugged, and fold compactly for transportation.

Schemes (c) and (d) eliminate the earthwork required by schemes (a) and (b).

Alternative construction techniques. An obvious means of reducing the required amount of cement or mortar to provide given rigidity is to increase the shell curvature by giving it a cusped shape. This has been done very inexpensively by simply anchoring ropes across the shell just prior to inflation. Upon inflation, the laminate bulges out between the restricting ropes to produce a cusped shape, having sharper curvature, therefore greater rigidity. For shell sizes and reinforcing fabrics commonly used, up to 1/4th of the material cost can typically be saved by this technique.

For sheet molding polymeric compounds, alternative means to initiate hardening of the shell after inflation include the application of heat; externally, or internally by preheating the air at the blower intake. Heat application is used in many plastic molding operations and is not the basis for a claim in this invention.

Means other than the perimeter posts (4) can be used to correctly position the shell in its raised position. For example, tether lines attached to the shell perimeter may be staked to the ground with sufficient slack so that they become taut when the shell rises to its correct position.

I claim:

1. A method of constructing inflated shell enclosures in which alternate layers of a cementing matrix and a fabric reinforcing material are placed over an inflatable membrane and anchored at their common perimeter, followed by inflation of said membrane to form a shell shape, and subsequently by adding a final material component, a chemical reactant, required to harden said cementing matrix.

* * * * *